US005263390A

United States Patent [19]

Levy et al.

[11] Patent Number: 5,263,390

[45] Date of Patent: Nov. 23, 1993

[54] MULTI-FASTENER ASSEMBLY TOOL

[75] Inventors: Robert B. Levy, Morrisville; Ivan Pawlenko, Holland; Brian D. Potteiger, Reading, all of Pa.

[73] Assignee: AT&T Bell Laboratories, Murray Hill, N.J.

[21] Appl. No.: 960,182

[22] Filed: Oct. 9, 1992

Related U.S. Application Data

[63] Continuation-in-part of Ser. No. 876,984, May 1, 1992, abandoned.

[51] Int. Cl.[5] ..... B25B 13/06

[52] U.S. Cl. ..... 81/125; 81/121.1

[58] Field of Search ..... 81/13, 125, 44, 451, 81/442, 448, 450, 177.2, 177.85, 121.1, 122, 123, 124.5, 184, 185.2, 180.1, 457

[56] References Cited

U.S. PATENT DOCUMENTS

| | | | |
|---|---|---|---|
| 851,181 | 4/1907 | McMurty | 81/121.1 X |
| 2,502,025 | 3/1950 | Raup | 81/125 |
| 3,788,169 | 1/1974 | Nakayama | 81/177.85 X |
| 4,512,219 | 4/1985 | Janssen | 81/180.1 X |
| 4,526,072 | 7/1985 | Monhoff, Jr. | 81/451 |
| 4,553,454 | 11/1985 | Laskey | 81/125 |

*Primary Examiner*—D. S. Meislin

*Attorney, Agent, or Firm*—Robert B. Levy

[57] ABSTRACT

A multi-fastener assembly tool (10, 10' and 10'') for engaging at least one threaded fastener (14) for securing the fastener to a threaded stud (20) includes a member (26) having a fastener locating and holding mechanism (27) at one end. The fastener locating and holding mechanism is adapted to be squeezed through the fastener to retain it on the member. The member is seated within, and is springbased from, a circumferentially disposed socket (32) sized to engage the fastener. A shaft (42), having a handle (44) at one end, is integrated to the socket to allow a force to be applied to urge the socket against the member once the fastener locating and holding means are aligned with the stud. As the socket is urged against the member, the threaded fastener is seated in the socket and is then pushed off the member to the stud. Once the fasteners is at the stud, a rotational motion is imparted to the handle to thread the fastener onto the stud.

1 Claim, 3 Drawing Sheets

MULTI-FASTENER ASSEMBLY TOOL

This application is a continuation-in-part of application Ser. No. 876,984, filed on May. ,1992, now abandoned.

TECHNICAL FIELD

This invention relates to a tool for engaging a stack of fasteners and for securing the fasteners to a threaded stud.

BACKGROUND OF THE INVENTION

In many assembly operations, two or more elements are secured to each other by way of a fastener, such as a nut or the like, threaded a on stud or bolt extending through the elements. Prior to threading the nut onto the stud, one or more fasteners, such as a flat washer, a split-ring washer or a star washer, or combination of such washers, are often placed onto the stud, in part, to retain the nut on the stud. In the past, placement of the washers onto the stud and threading the nut to the stud to secure the washers has been a multi-step operation. Typically, each washer must be placed individually on the stud, usually by hand, before attaching the nut. If the washers are small, then a tweezers or other type of gripper must be employed.

Once the washers have been individually placed on the stud, then the nut is attached. Attachment of the nut to the stud is typically accomplished by first threading the nut to the stud by hand and then using a tool, such as a socket, nut driver or wrench, to thread the nut fully onto the stud with the appropriate torque. Alternatively, with a tool such as a nut driver or socket, the nut can be placed in the tool and attached to the stud by the tool without first manually threading the nut onto the stud.

While the steps of manually placing each washer on the stud and thereafter attaching the nut may seem relatively insignificant for a single assembly operation, on a repetitive basis, the time spent performing these operations can be significant. Moreover, in many instances, the physical size and location of the stud can make it very difficult to manually place each washer on the stud prior to attachment of the nut.

Therefore, there is a need for a technique for engaging one or more washers and a nut in a single operation and then collectively placing them on the stud.

SUMMARY OF THE INVENTION

Briefly, in accordance with a first aspect of the invention, a multifastener assembly tool is provided for engaging at least one threaded fastener (i.e., a nut) and, preferably, a stack of fasteners (i.e., a stack of washers lying below the nut), and for attaching the fasteners to a threaded stud. The tool comprises a member, typically in the form of a pin, which has a fastener locating and retaining means (i.e., a pair of compressible spring fingers) at one of its ends. The fastener locating and retaining means are sized for receipt through each fastener in the stack so as to hold the fasteners on the member and to locate them in alignment with the stud. A socket coaxially surrounds the member and is spring-biased therefrom so that the fastener locating and retaining means extends therebeyond. The socket is sized to receive and seat the fastener (typically, a threaded nut) held on the member furthest from the fastener locating and retaining means. A shaft extends from the socket opposite the member to enable a force to be applied to the socket to urge the member into the socket once the fastener locating and retaining means is brought into contact with the stud. As the member is urged into the socket, the fasteners on the member are forced to seat in the socket. Once seated, a continued force on the shaft causes the fasteners to be urged by the socket over a fastener retaining and holding means onto the stud. Once the fasteners are placed on the stud, then a torque can be applied to the shaft to thread the nut onto the stud to secure the washers beneath the nut.

DETAILED DESCRIPTION

Figure 1:
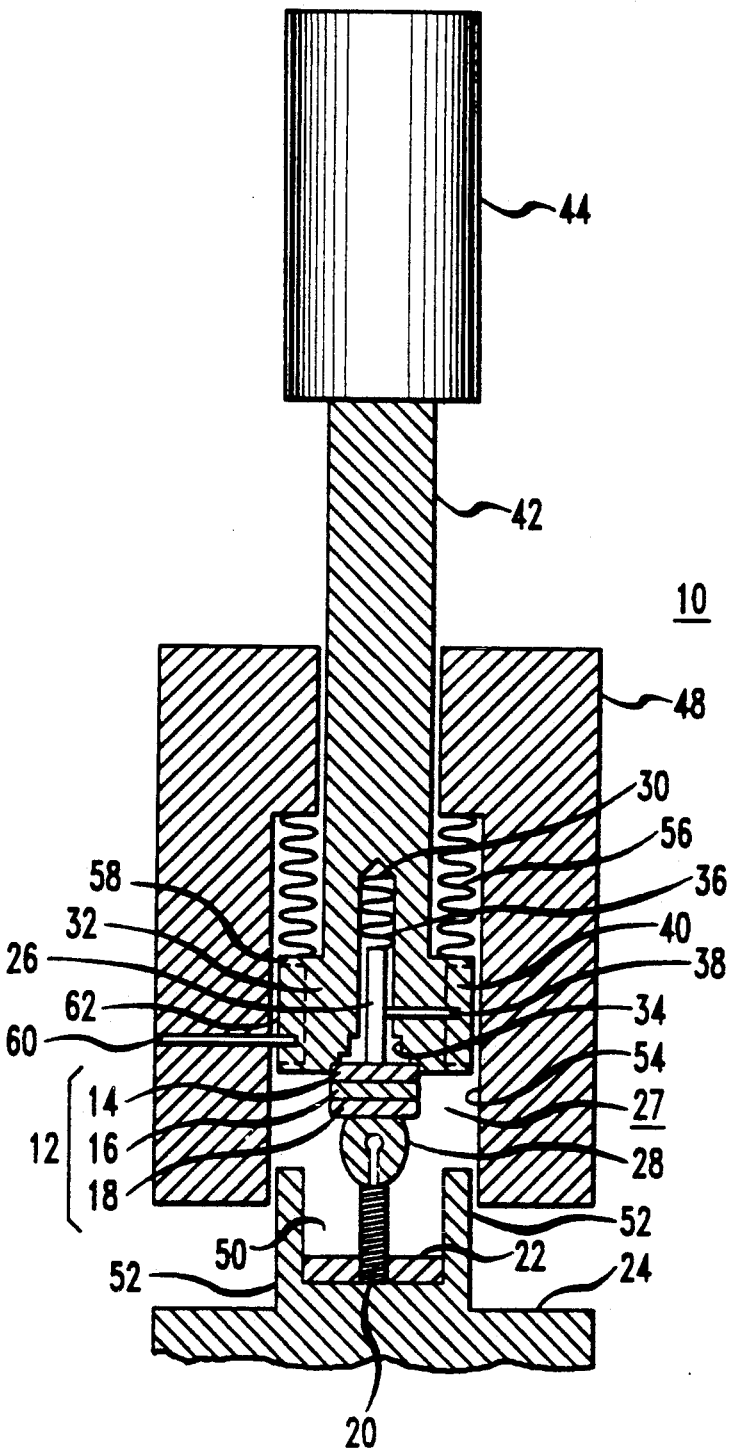
FIG. 1 is frontal view, in cross section, of a first preferred embodiment of a multi-fastener assembly tool in accordance with the invention.

FIG. 1 shows a frontal view, in cross-section, of a multi- fastener assembly tool 10, in accordance with a first preferred embodiment of the invention. As will be described below, the tool 10 advantageously serves to releasably retain a fastener stack 12, typically comprised of a nut 14, a split-ring washer 16, and a flat washer 18 (in descending order), and to align the fasteners with a threaded stud 20. The tool 10 also serves to place the washers 16 and 18, as well as the nut 14, onto the stud 20, and to thread the nut to the stud to secure a first element 22 to a second element 24.

The tool 10 comprises a central member 26, having a fastener locating and retaining mechanism 27 at its lower end which takes the form of a pair of arcuate spring fingers 28-28 sized so as to be squeezed through the aperture (not shown) in each of the fasteners 14, 16 and 18. Once the spring fingers 28-28 are urged though the aperture in each of the fasteners 14, 16 and 18, the fingers spread apart so that the fasteners are thus retained on the member 26.

The member 26 seats in a passage 30 centrally disposed in a socket 32 having a counter-bore 34 in its lower end which communicates with the passage 30. The counter-bore 34 is surrounded by a plurality of angled walls (not shown) which each engage a separate one of the sides of the nut 14. In practice, the counter-bore 34 is of a depth slightly greater than the thickness of the nut 14. A spring 36 is seated in the upper end (as seen in FIG. 1) of the passage 30 in contact with the upper end of the member 26 to yieldably urge the member outwardly from the socket 32 (downward as seen in FIG. 1) so that the nut 14 at the top of the fastener stack 12 lies below, and is out of engagement with, the counter-bore 34. Projecting horizontally outwardly from the member 26 is a finger 38 which extends into, for travel along, a vertical channel 40 in the socket 32. The position of the finger 40 on the member 26, as well as the length of the channel 40 within the socket 32, is selected to limit the movement of the member outwardly (downwardly in FIG. 1) from the socket.

The socket 32 has an integral shaft 42, which, as seen in FIG. 1, extends upwardly from the socket in a direction opposite the member 26. The shaft 42 has an integral handle 44 at its upper end which is typically knurled to facilitate gripping by an operator.

An optional guide 48 may be provided to circumscribe socket 32 to facilitate alignment of the spring fingers 28—28 at the lower end of the member 26 with the stud 20 when the stud is situated in a well 50 surrounded by a set of walls 52—52. To this end, the guide 48 has an opening 54 in its lower end sized slightly larger than the spacing between the opposite outer edges of the walls 52—52. A spring 56 is disposed between the guide 46 and a shoulder 58 on the outer periphery of the socket 32 to yieldably bias the guide upwardly. A pin 60 extends laterally out from the guide 58 into a vertical channel 62 in the outer periphery of the socket 32 to limit the travel of the guide.

The tool 10 serves to secure the nut 14 and the washers 16 and 18 on the stud 20 in the following manner. First, the nut 14 and the washers 16 and 18 are retained on the member 26 by yieldably urging the spring fingers 28-28 through the aperture in each of the fasteners. After the fingers 28—28 are urged through the fasteners, the fasteners are thus retained on the member 26 above the fingers. Once the fasteners 14, 16 and 18 are engaged, the tool 10 is positioned by an operator so that the spring fingers 28—28 are in aligned registration with the stud 20. Thereafter, a downward force is applied to the handle 44 so that the member 26 is yieldably urged upwardly into the socket 32, causing the nut 14 to seat in the counter-bore 34. With the nut 14 now seated in the socket counter-bore 34, a further downward force on the handle 44 will cause the socket 32 to push the nut 14 and the washers 16 and 18 over the spring fingers 28—28 and onto the stud 20. Thereafter, a torque is applied to the handle 44 so that the socket 26 threads the nut 14 onto the stud 20.

Figure 2:
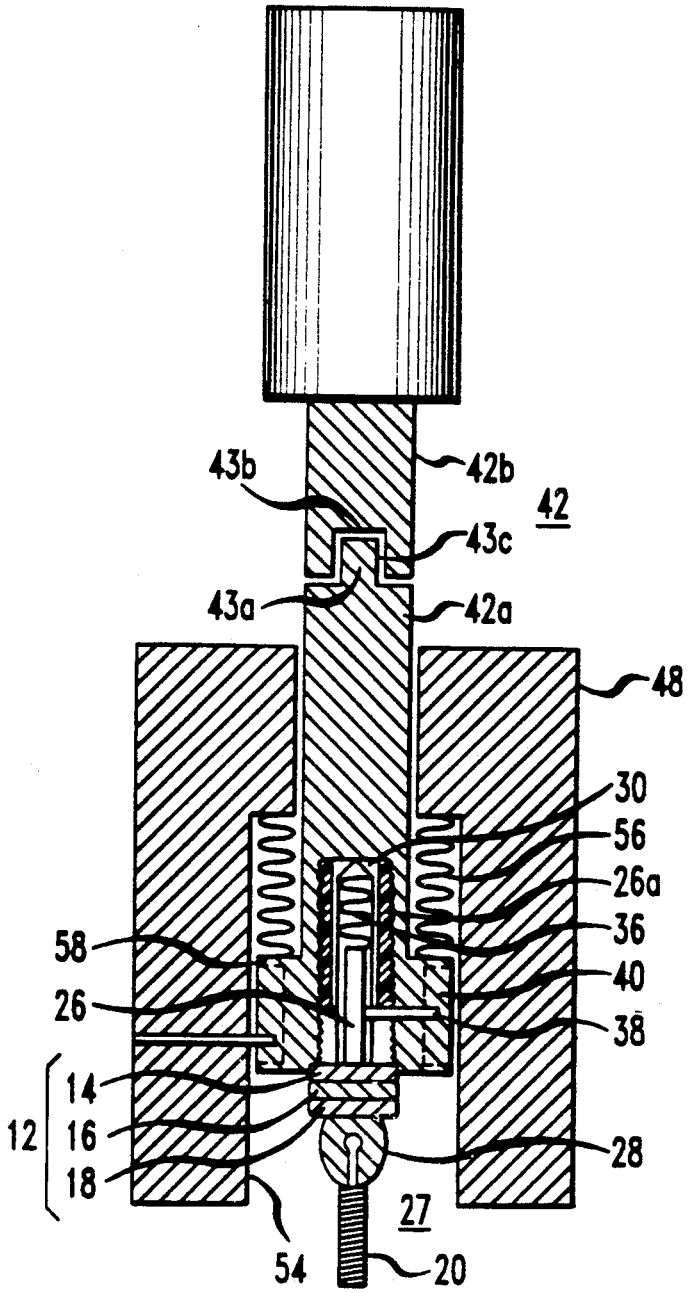
FIG. 2 is a partial frontal view, in cross-section, of a second preferred embodiment of the tool of FIG. 1.

Referring now to FIG. 2, there is shown a second preferred embodiment 10' of a multi-fastener assembly tool in accordance with the invention. The tool 10' of FIG. 2 is identical in most respects to the tool 10 of FIG. 1 and therefore like reference numbers have been used in FIG. 2 to describe like parts. However, the tool 10' of FIG. 2 differs from the tool 10 of FIG. 1 in the following respects. First, the tool 10' has a two-piece shaft 42, comprised of a lower portion **42*a*, integral with the socket 32, and an upper portion 42*b*, integral with the handle 44. The lower shaft portion 42*a* has a square head 43*a* at its upper end sized for receipt in a square socket 43*b* in the lower end of the upper shaft portion 42*b*. The head 43*a* has a spring loaded ball 43*c* protruding laterally therefrom for receipt in a detent (not shown) in the socket 43*b*. In practice, the square head 43*a* at the upper end of the lower shaft portion 43*b*** is sized to be engaged by a conventional ¼", ⅜" or ½" socket drive.

Another difference is that the tool 10' has its member 26 disposed within a casing **26*a* whose exterior periphery is threaded for threaded engagement into a passage 30 in the socket 32. A spring 36 is disposed within the casing 26*a* between its upper end (as seen in FIG. 2) and the member 26 to urge the member outwardly (downwardly) from the socket 32. As with the tool 10 of FIG. 1, the member 26 of the tool 10' of FIG. 2 is provided with a pin 38 which extends horizontally outwardly to ride in the channel 40 in the socket 32** to limit the travel of the member.

The advantage of seating the member 26 in the casing **26*a* which is threaded into the socket 32 is that the casing can easily be removed and replaced with one containing a member which is longer. In some instances, a longer member 26 may be desirable, especially where the fasteners 14, 16 and 18** are relatively thick, or there are a large number of such fasteners in the stack.

The foregoing discloses various embodiments of a multi-fastener assembly tool 10, 10' and 10'' for engaging and retaining a plurality of fasteners 14, 16 and 18, and for attaching the fasteners to a threaded stud.

Figure 3:
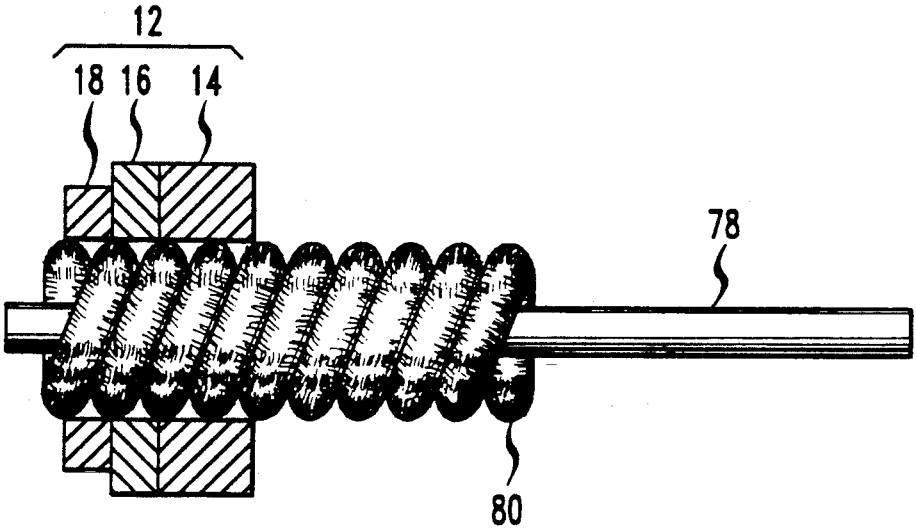
FIG. 3 is a side view of an alternate preferred embodiment of a fastener-locating and retaining mechanism for use with the tools of FIGS. 1-3.

FIG. 3 is a side view of an alternate preferred embodiment of a fastener-locating and -retaining mechanism 27' for use with each of the fastening tools 10, 10' and 10'' of FIGS. 1, 1 and 3, respectively, in place of the mechanism 27 shown in each figure. The fastening and locating mechanism 27' of FIG. 4 comprises a central member 78, typically taking the form of two or more strands of wire (not shown) twisted about each other. A plurality of bristles 78, typically made for NYLON fabric or the like, is affixed to the central member 78 so as to project redially outwardly. As seen in FIG. 4, the bristles 80, spiral about the central member 78 although it should be understood that the bristles can be arranged in a different pattern.

The outside diameter of the central member 78 and the thickness (i.e., the outward radial extension ) of the bristles 80 are selected such that each of the fasteners 14, 16 and 18 of the fastener set 12 can be slid onto, so as to circumscribe, the bristles. The bristles 80 are chosen to be deformable by the fasteners 14, 16 and 18, the central member is placed therethrough, yet the bristles have a sufficient resilience to engage the fasteners to hold them in place. In this way, the fastener-locating and -retaining mechanism 27' serves to engage and retain the fasteners 14, 16 and 18.

It is to be understood that the above-described embodiments are merely illustrative of the principles of the invention. Various modifications and changes may be made thereto by those skilled in the art which will embody the principles of the invention and fall within the spirit an scope thereof.

We claim:

1. A method for releasably engaging at least one washer and a threaded fastener, both having an aperture therethrough and for attaching the fastener and washer onto a threaded stud, comprising the steps of:

yieldably squeezing a compressible fastener locating and holding means at one end of a member through the aperture in the washer and fastener so that both are held about the member but out of engagement with a socket circumferentially disposed about the member;

placing the fastener locating and holding means in contact with a threaded stud;

applying a force to the socket to urge the member into the socket to first seat the fastener in the socket and thereafter force the fastener and washer off the member and onto the threaded stud; and thereafter imparting a torque to the socket to thread the fastener onto the stud.

* * * * *